US008824720B2

(12) United States Patent
Wu et al.

(10) Patent No.: US 8,824,720 B2
(45) Date of Patent: Sep. 2, 2014

(54) DETACHABLE EARPHONE

(75) Inventors: Jin-Bang Wu, Shenzhen (CN); Zhi-Hua Lin, Shenzhen (CN); Yi Xiong, Shenzhen (CN)

(73) Assignees: Fu Tai Hua Industry (Shenzhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 338 days.

(21) Appl. No.: 13/305,823

(22) Filed: Nov. 29, 2011

(65) Prior Publication Data

US 2013/0022227 A1 Jan. 24, 2013

(30) Foreign Application Priority Data

Jul. 19, 2011 (CN) ..... 2011 1 0202104

(51) Int. Cl.
*H04R 25/00* (2006.01)
*H04R 1/10* (2006.01)
*H04R 9/02* (2006.01)

(52) U.S. Cl.
CPC ..... *H04R 1/1033* (2013.01); *H04R 2420/09* (2013.01)
USPC ..... 381/374; 381/333; 381/388

(58) Field of Classification Search
CPC .. H04R 1/1066; H04R 5/0335; H04R 1/1033; H04R 1/10
USPC ..... 381/374, 380, 370, 371, 333, 388
See application file for complete search history.

(56) References Cited

U.S. PATENT DOCUMENTS

2005/0215111 A1* 9/2005 Weikel et al. ..... 439/502
2007/0178771 A1* 8/2007 Goetz et al. ..... 439/669

* cited by examiner

*Primary Examiner* — Curtis Kuntz
*Assistant Examiner* — Sunita Joshi
(74) *Attorney, Agent, or Firm* — Novak Druce Connolly Bove + Quigg LLP

(57) ABSTRACT

A detachable earphone is disclosed. The detachable earphone comprises an audio plug; an earplug; and an earphone cable connecting the audio plug to the earplug, wherein at least one of the audio plug and the earplug forms a joining portion, at least one end of the earphone cable forms an insertion portion, and the insertion portion is detachably engaged in the joining portion.

8 Claims, 3 Drawing Sheets

DETACHABLE EARPHONE

BACKGROUND

1. Technical Field

The present disclosure generally relates to earphones, and particularly, to a detachable earphone.

2. Description of the Related Art

An earphone generally includes an earplug, an audio plug, and an earphone cable connecting the earplug to the audio plug. However, in use, a joint part of the earplug and the earphone cable, or audio plug and the earphone cable may be easily damaged by pulling or bending of the earphone. Because the earphone cable is soldered to the earplug and to the audio plug, if any one of the earphone cable, the audio plug, and the earplug is damaged, the whole earphone may need to be replaced. Thereby wasting a lot of material for making the earphone.

Therefore, there is room for improvement within the art.

BRIEF DESCRIPTION OF THE DRAWING

The components in the drawings are not necessarily drawn to scale, the emphasis instead placed upon clearly illustrating the principles of the present disclosure. Moreover, in the drawings, like reference numerals designate corresponding parts throughout the several views.

DETAILED DESCRIPTION

Figure 1:
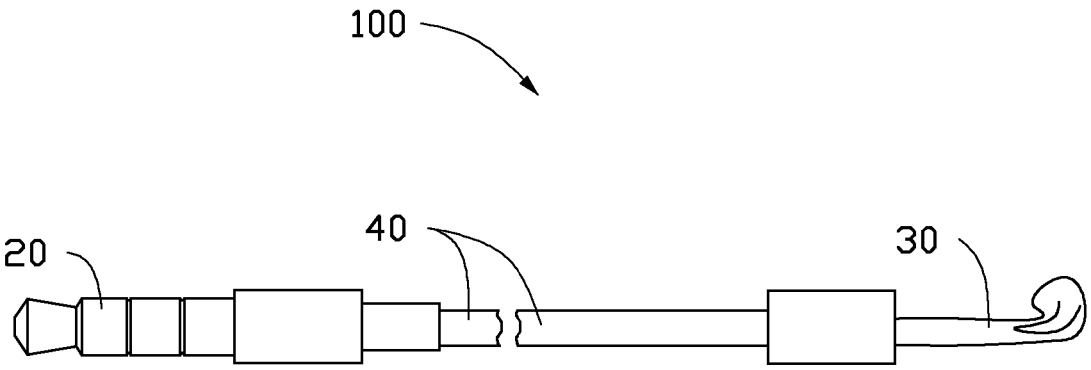
FIG. 1 is a schematic view of an embodiment of an earphone comprising an audio plug, an earplug, and an earphone cable.

Referring to FIG. 1, an embodiment of an earphone 100 comprises an audio plug 20, an earplug 30, and an earphone cable 40 detachably connected to the audio plug 20 and the earplug 30.

Figure 2:
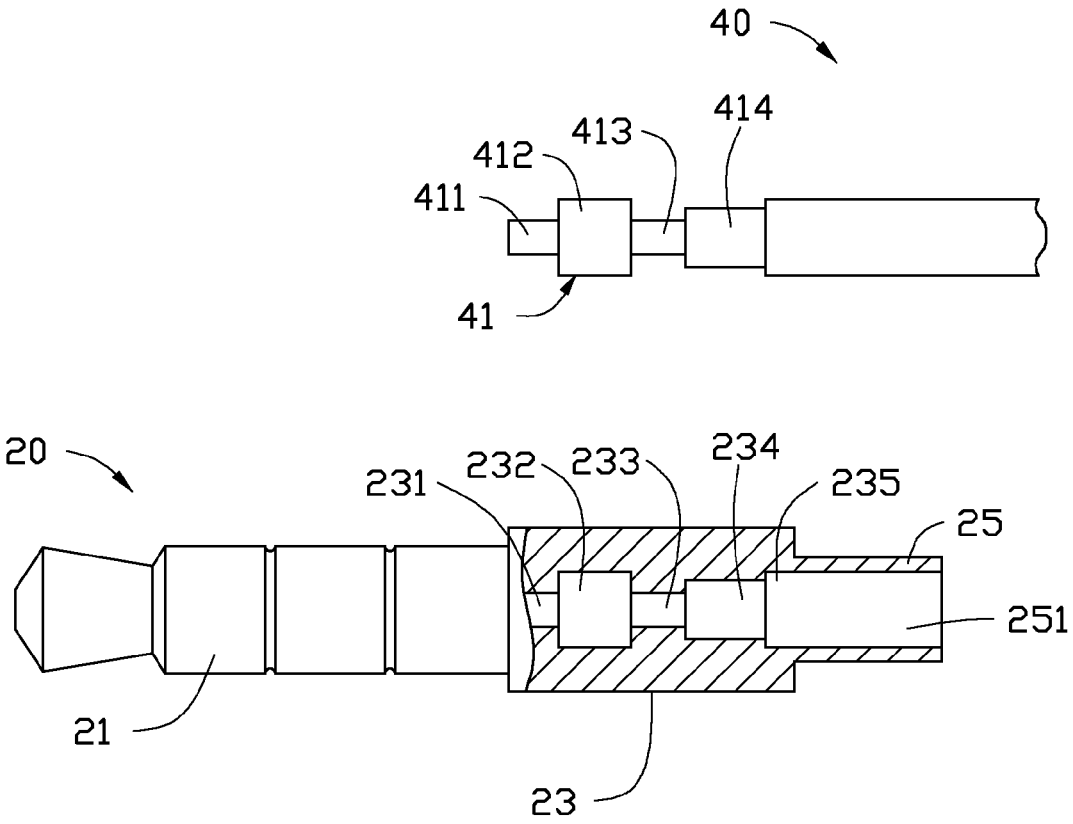
FIG. 2 is a schematic view of the audio plug and the earphone cable of FIG. 1.
Figure 3:
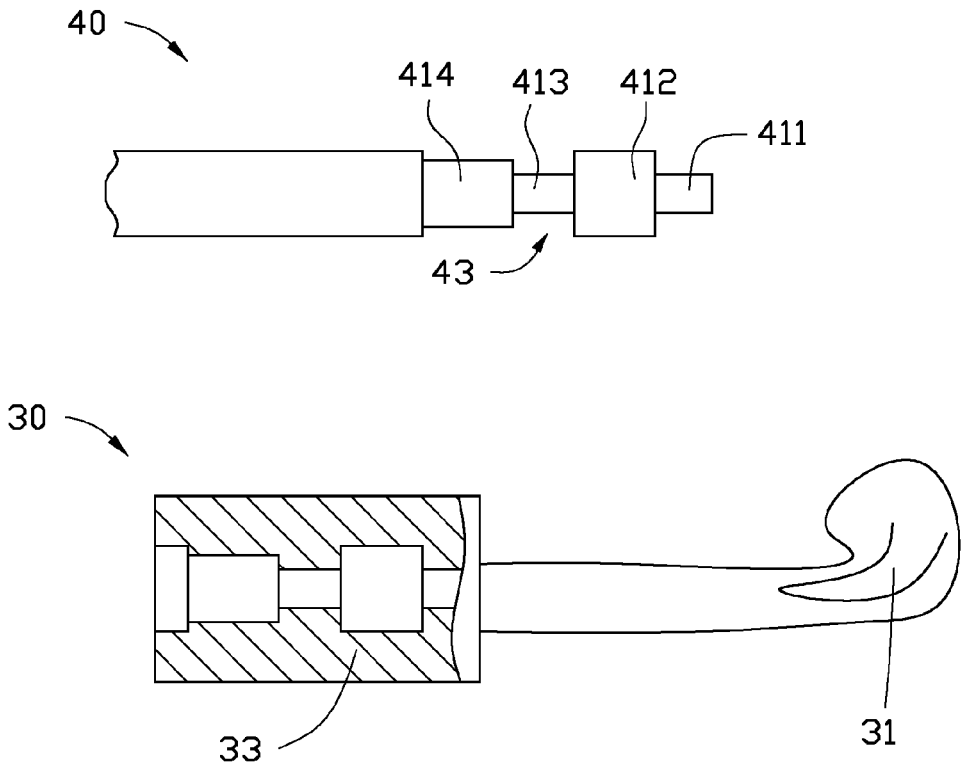
FIG. 3 is a schematic view of the earplug and the earphone cable of FIG. 1.

Referring to FIGS. 2 and 3, the audio plug 20 comprises a metal joint 21, a first joining portion 23 formed on an end of the metal joint 21, and a positioning portion 25 formed on an end of the first joining portion 23, away from the metal joint 21. The audio plug 20 may be connected to an audio device (not shown). The first joining portion 23 defines a first receiving groove 231, a second receiving groove 232, a third receiving groove 233, a fourth receiving groove 234, and a fifth receiving groove 235, all of which are coaxial and interconnected with each other. A diameter of the second receiving groove 232 is larger than that of the first receiving groove 231 and that of the third receiving groove 233. A diameter of the fourth receiving groove 234 is larger than that of the third receiving groove 233, and a diameter of the fifth receiving groove 235 is larger than that of the fourth receiving groove 234. The positioning portion 25 axially defines a positioning hole 251.

The earphone cable 40 is made by wrapping a plastic layer on a copper wire. The earphone cable 40 comprises a first insertion portion 41 connected to the audio plug 20, and a second insertion portion 43 connected to the earplug 30. Both of the first insertion portion 41 and the second insertion portion 43 have stepped portions. Each of the first insertion portion 41 and the second insertion portion 43 comprise a first connecting portion 411, a second connecting portion 412, a third connecting portion 413, and a fourth connecting portion 414, all of which are coaxial. A diameter of the second connecting portion 412 is larger than that of the first connecting portion 411 and that of the third connecting portion 413. A diameter of the fourth connecting portion 414 is larger than that of the third connecting portion 413.

In an illustrated embodiment, the first insertion portion 41 and the second insertion portion 43 are formed by grinding. The earphone cable 40 is positioned on a grinding device (not shown), and extends in a straight line. A grinding wheel (not shown) of the grinding device is rotated in a clockwise direction, and the earphone cable 40 is rotated in a counterclockwise direction when the grinding wheel contacts the earphone cable 40. Therefore, the first insertion portion 41 and the second insertion portion 43 are formed on opposite ends of the earphone cable 40 by the grinding wheel.

Because the earphone cable 40 is made by wrapping plastic layer on a copper wire, the earphone cable 40 is flexible. The first insertion portion 41 is inserted into the first joining portion 23 of the audio plug 20, and then the first connecting portion 411 is engaged in the first receiving groove 231, the second connecting portion 412 is engaged in the second receiving groove 232, the third connecting portion 413 is engaged in the third receiving groove 232, the fourth connecting portion 414 is engaged in the fourth receiving groove 234, and a part of the earphone cable 40 adjacent to the first insertion portion 41 is received in the fifth receiving groove 235 and the positioning hole 251. The earphone cable 40 may then be electrically connected to the audio plug 20. When the earphone cable 40 is pulled by a sudden external force, the first insertion portion 41 may be detached from the audio plug 20, thereby avoiding damaging the earphone 100.

Referring again to FIG. 3, the earplug 30 comprises a main body 31, and a second joining portion 33 extending from an end of the main body 31. The second joining portion 33 has a same shape as the first joining portion 23. The second insertion portion 43 is inserted into the second joining portion 33, and then the earphone cable 40 is electrically connected to the earplug 30. When the earphone cable 40 is pulled by a sudden external force, the second insertion portion 43 may be detached from the earplug 30, thereby avoiding damaging the earphone 100.

The first joining portion 23 and the second joining portion 33 may define two or more receiving grooves, and the first insertion portion 41 and the second insertion portion 43 may form two or more corresponding connecting portions. In addition, the first joining portion 23 and the second joining portion 33 may have different structures. The first joining portion 23 and the second joining portion 33 may be formed on opposite ends of the earphone cable 40, and the first insertion portion 41 and the second insertion portion 43 may be formed on the audio plug 20 and the earplug 30. Furthermore, the earphone cable 40 may be fixedly connected to one of the audio plug 20 and the earplug 30, and detachably connected another one of the audio plug 20 and the earplug 30.

When any of the audio plug 20, the earplug 30, and the earphone cable 40 is damaged, a user may only need to replace a damaged part of earphone 100, instead of replacing the whole earphone 100, because the audio plug 20, the earplug 30, and the earphone cable 40 are detachably connected. When the earphone cable 40 is pulled by a sudden external force, the first insertion portion 41 may be detached from the audio plug 20, or the second insertion portion 43 may be detached from the earplug 30, thereby avoiding damaging the earphone 100.

While the present disclosure has been described with reference to particular embodiments, the description is illustrative of the disclosure and is not to be construed as limiting the disclosure. Therefore, various modifications can be made to the embodiments by those of ordinary skill in the art without departing from the true spirit and scope of the disclosure, as defined by the appended claims.

What is claimed is:

1. An earphone, comprising:

an audio plug;

an earplug; and an earphone cable connecting the audio plug to the earplug, wherein at least one of the audio plug and the earplug forms a joining portion, the joining portion defines a plurality of receiving grooves interconnected with each other along an axis of the joining portion, a diameter of one receiving groove is greater or less than diameters of two neighboring receiving grooves connected with the receiving groove, at least one end of the earphone cable forms an insertion portion, the insertion portion comprises a plurality of connecting portions interconnected with each other along an axis of the inserting portion, a diameter of one connecting portion is greater or less than diameters of two neighboring connecting portions connected with the connecting portion, and each connecting portion of the plurality of connecting portions is detachably engaged in corresponding receiving groove of the plurality of receiving grooves.

2. The earphone of claim 1, wherein the earphone cable is a copper wire wrapped in a plastic layer.

3. The earphone of claim 1, wherein the joining portion is formed on the earplug, the earplug comprises a main body connected to the joining portion.

4. The earphone of claim 1, wherein the joining portion is formed on the audio plug, the audio plug comprises a metal joint connected to the joining portion.

5. The earphone of claim 1, the audio plug has a first joining portion, the earplug has a second joining portion, the earphone cable has a first insertion portion and a second insertion portion on opposite ends of the earphone cable; wherein the first insertion portion is detachably engaged in the first joining portion, and the second insertion portion is detachably engaged in the second joining portion.

6. The earphone of claim 5, wherein the audio plug further comprises a positioning portion formed on an end of the joining portion away from the metal joint, and the positioning portion axially defines a positioning hole.

7. The earphone of claim 1, wherein the plurality of connecting portions comprises a first connecting portion, a second connecting portion, a third connecting portion, and a fourth connecting portion, wherein the first connecting portion, the second connecting portion, the third connecting portion, and the fourth connecting portion are coaxial; a diameter of the second connecting portion is larger than both a diameter of the first connecting portion, and a diameter of the third connecting portion; a diameter of the fourth connecting portion is larger than the diameter of the third connecting portion; and the plurality of receiving grooves comprises a first receiving groove, a second receiving groove, a third receiving groove, a fourth receiving groove, a fifth receiving groove, wherein the first receiving groove, the second receiving groove, the third receiving groove, the fourth receiving groove, and the fifth receiving groove are coaxial and interconnected with each other; the first connecting portion is received in the first receiving groove, the second connecting portion is received in the second receiving groove, the third connecting portion is received in the third receiving groove, the fourth connecting portion is received in the fourth receiving groove, and the earphone cable is partially received in the fifth receiving groove.

8. The earphone of claim 1, wherein the insertion portion is made by grinding the at least one end of the earphone cable.

* * * * *